US008978906B2

(12) United States Patent
Feeley et al.

(10) Patent No.: US 8,978,906 B2
(45) Date of Patent: Mar. 17, 2015

(54) IMPACT-RESISTANT CASING FOR BREAKABLE CONTAINERS

(71) Applicant: Silikids, LLC, Los Angeles, CA (US)

(72) Inventors: Stacey Feeley, Traverse City, CA (US); Giuliana Schwab, Studio City, CA (US)

( * ) Notice: Subject to any disclaimer, the term of this patent is extended or adjusted under 35 U.S.C. 154(b) by 0 days.

(21) Appl. No.: 13/672,480

(22) Filed: Nov. 8, 2012

(65) Prior Publication Data

US 2013/0240475 A1 Sep. 19, 2013

Related U.S. Application Data

(63) Continuation of application No. 12/558,477, filed on Sep. 11, 2009, now abandoned.

(60) Provisional application No. 61/157,543, filed on Mar. 4, 2009.

(51) Int. Cl.

| | |
|---|---|
| ***B65D 6/00*** | (2006.01) |
| ***B65D 25/20*** | (2006.01) |
| ***A61J 9/06*** | (2006.01) |
| ***A61J 9/08*** | (2006.01) |

(52) U.S. Cl.

CPC . *B65D 25/20* (2013.01); *A61J 9/06* (2013.01); *A61J 9/08* (2013.01)

USPC ..... 215/11.6; 215/11.1; 215/376; 220/737; 220/739

(58) Field of Classification Search

USPC ..... 220/737–739, 903; 215/11.1, 385, 376, 215/393, 11.6

See application file for complete search history.

(56) References Cited

U.S. PATENT DOCUMENTS

| | | | | |
|---|---|---|---|---|
| 1,346,683 | A * | 7/1920 | Reynolds | 2/161.8 |
| 2,591,374 | A * | 4/1952 | Place | 215/371 |
| 2,706,571 | A * | 4/1955 | Ryan | 215/12.1 |
| 2,932,423 | A * | 4/1960 | Baumgartner | 220/737 |
| 5,312,013 | A * | 5/1994 | Bridges | 220/625 |
| 5,810,195 | A * | 9/1998 | Sim | 220/674 |
| 7,156,570 | B2 * | 1/2007 | Cetera | 401/6 |
| 2008/0078824 | A1 * | 4/2008 | Spriegel et al. | 229/403 |
| 2009/0057257 | A1 * | 3/2009 | Marcus et al. | 215/11.6 |
| 2009/0114791 | A1 * | 5/2009 | Alger | 248/346.11 |

* cited by examiner

*Primary Examiner* — Tri Mai

(74) *Attorney, Agent, or Firm* — Richards Patent Law P.C.

(57) ABSTRACT

The teachings provided herein are directed to an impact-resistant casing for breakable containers, and a system comprising the impact-resistant casing and a breakable container, such as a glass container. Very useful systems incorporating these components could include, of course, a glass baby bottle, a toddler sippy-cup, or an adult drinking glass, for example. These and other embodiments will be apparent to one of skill upon a review of the teachings provided herein.

17 Claims, 8 Drawing Sheets

IMPACT-RESISTANT CASING FOR BREAKABLE CONTAINERS

CROSS-REFERENCE TO RELATED APPLICATIONS

This application is a continuation of U.S. patent application Ser. No. 12/558,477, filed on Sep. 11, 2009, which claims the benefit of U.S. Provisional Application No. 61/157,543, filed Mar. 4, 2009; each application of which is herein incorporated by reference in its entirety.

BACKGROUND

1. Field of the Invention

The teachings provided herein are directed to an impact-resistant casing for breakable containers, and a system comprising the impact-resistant casing and a breakable container.

2. Description of the Related Art

Plastic packaging of foods and beverages has long been a solution to the problems associated with the use of breakable containers, such as glass containers. Glass packaging, however, is recognized and accepted as a clean technology, superior to other packaging in many respects. For example, glass is made from sand, soda ash, and limestone—abundant raw materials that deliver superior purity, quality, safety, and taste of contents. The ability of glass packaging to be infinitely recycled into new glass bottles and jars also saves raw materials and energy. Even after continued recycling, glass never loses its original quality, purity, or clarity.

In the past, food and beverage containers were often formed of glass and were generally found to be very effective. Unfortunately, shortfalls were found to exist in the use of glass. Its well known that glass can break, and broken glass can be dangerous, particularly to a child or pets. Glass baby bottles, for example, can become slick, difficult to hold, particularly when wet, which further adds to the risks of dropping the baby bottle. In addition, glass is susceptible to breakage when it undergoes rapid temperature change, such as going from a refrigerator straight in to a microwave or from the microwave straight to the refrigerator. Parents have been using plastic baby bottles to help address these problems, because plastic baby bottles are relatively inexpensive and less susceptible to breaking. Moreover, plastic baby bottles are also lighter, tend to be easier to grip and, if dropped, there is little risk that the plastic baby bottle will ever break.

New data on the leaching of unwanted chemicals from plastics has resulted in a general acceptance that products packaged in glass are healthier for people and the environment than the plastic alternatives. Glass is inert, impermeable, and offers a natural shield that protects the contents of the container. In contrast to plastics, glass eliminates the risk of unwanted chemicals migrating into food and drink. Moreover, consumers continuously tell us that they prefer glass—they overwhelmingly select glass for food and drink when it's practical to do so, due to the belief that food and drink tastes better from a glass container.

The new data on the leaching of unwanted chemicals from plastics includes data on plastic baby bottles. It's recently been shown that plastic baby bottles contain a dangerous chemical called bisphenol A (BPA), a synthetic hormone which may cause infertility, cancer and hormonal imbalances in children. BPA has been shown to leach out of plastics when heated and endanger the health of consumers. Such plastics include hard polycarbonate plastic that is used in baby bottles, toddler cups, and water bottles.

The Environmental Health Fund (EHF) released a study titled "Baby's Toxic Bottle: Bisphenol A Leaching from Popular Brands of Baby Bottles," which shows BPA leaches from popular brands of plastic baby bottles when the bottles are heated. The study does not stand alone, as other research was also published earlier this month. According to the EHF report, BPA is "a developmental, neural, and reproductive toxicant that mimics estrogen and can interfere with healthy growth and body function." The authors warn that animal studies conducted have shown that the chemical "causes damage to reproductive, neurological and immune systems during critical stages of development, such as infancy and in the womb." The authors further warned that some 95 percent of baby bottles on the market, in the US and Canada, contain BPA. Among the brands tested were Avent, Disney/The First Years, Dr. Brown's, Evenflo, Gerber and Playtex. All were found to release alarming levels of BPA when heated. In fact, according to Forbes.com, the United States and Canada have shown great alarm regarding a publication discussing the use of BPA in various consumer products and the release of the BPA from the products when they're heated:

> "This is quite concerning. All 19 polycarbonate bottles [investigated in the study] leached BPA when heated. This is clearly showing that BPA is certainly leaching from popular and common consumer products," Judith Robinson, special projects director with the Environmental Health Fund, was quoted by Forbes as stating Thursday . . . We're calling for an immediate moratorium on the use of BPA in all baby bottles, as well as all food and beverage containers. It's not necessary, and we're calling for an end to it immediately."

As such, its now generally understood that glass containers offer superior performance, health benefits, and environmental impact over other types of containers. The performance benefits are particularly pronounced when the glass containers are used for food and drink. The reduction in use of glass containers is most directly linked to the risk of the breakage of the container. Accordingly, one of skill will certainly appreciate an impact-resistant casing that absorbs impact to the container, resists breakage, and retains fractured material from a breakage, thus providing a solution to the problems associated with the use of such breakable containers and a healthier and greener alternative for society.

SUMMARY

The teachings provided herein are directed to an impact-resistant casing for breakable containers, and a system comprising the impact-resistant casing and a breakable container, such as a glass container. These and other embodiments will be apparent to one of skill upon a review of the teachings provided herein.

In some embodiments, the teachings are directed to an impact-resistant casing for a breakable container. The casing comprises a structural material having an inner surface adapted to contact an outer surface of a breakable container. The structural material functions as an outer protective layer for the breakable container. In these embodiments, the casing further comprises a shock absorber that functions to absorb an impact received by the breakable container and resist breakage of the breakable container upon receiving the impact. In some embodiments, the breakable container comprises, for example, a glass container, a drinking glass, or a glass baby bottle.

In some embodiments, the structural material comprises an elastomeric material, such as an elastomeric silicone material. In some embodiments, the structural material comprises a silicone rubber selected from the group consisting of ASTM D-2000 type FC, FE, and EG.

In some embodiments, the shock absorber comprises an elastomeric material, such as an elastomeric silicone material. In some embodiments, the shock absorber comprises a silicone rubber selected from the group consisting of ASTM D-2000 type FC, FE, and EG.

In some embodiments, the structural material and the shock absorber comprise a silicone rubber independently selected from the group consisting of ASTM D-2000 type FC, FE, EG, and a combination thereof.

In some embodiments, the shock absorber comprises an elastomeric protuberance that extends outward from the surface of the structural material. The shock absorber can function to substantially reduce the frequency of breakage due to a force applied to the container at the site of the shock absorber when compared to the frequency of breakage due to the force applied to the container through a second casing consisting of the same structural material and not having a shock absorber at the site of the applied force. In some embodiments, the shock absorber comprises an elastomeric material having the shape of a ring. And, in some embodiments, the shock absorber comprises concentric rings of an elastomeric material. The shock absorber can comprise an elastomeric material having a conical shape with a taper that distributes force upon impact to inhibit stress concentrations at the surface of the breakable container. In some embodiments, the shock absorber can comprise one or more elastomeric protuberances that circumscribe an opening in the structural material.

The shock absorber can be placed at any conceivable location around the breakable container to reduce the frequency of breakage upon an impact. In some embodiments, the container has a base and a side, and the shock absorber is positioned at the base of the container. And, in some embodiments, the shock absorber is positioned at the side of the container.

The casing not only reduces the frequency of breakage, but it also reduces the risk of breakage. In some embodiments, the structural material retains fractured material following a breakage of the breakable container. The casing can also be modified for easier application to, and removal from, the breakable container. In some embodiments, the inner surface of the casing has a coating that assists in the application and removal of the casing.

In some embodiments, the teachings are directed to an impact-resistant storage container system comprising a breakable container and any of the casings described above. In some embodiments, the teachings are directed to a drinking system. The drinking system can comprise a drinking glass having a base, a side, and an inner volume for containing a fluid; and, an impact-resistant casing comprising a structural material having an inner surface adapted to contact an outer surface of the drinking glass. In these embodiments, the structural material functions as an outer protective layer for the drinking glass. In these embodiments, the system also includes a shock absorber that functions to absorb an impact received by the drinking glass and resist breakage of the drinking glass upon receiving the impact. The structural material and the shock absorber comprise a silicone rubber independently selected from the group consisting of ASTM D-2000 type FC, FE, EG, and a combination thereof. In some embodiments, the drinking glass is a baby bottle.

The drinking system can include a shock absorber positioned at the base of the drinking glass and/or the side of the drinking glass. In some embodiments, the shock absorber comprises an elastomeric material having the shape of a ring. And, in some embodiments, the shock absorber comprises concentric rings of an elastomeric material. The shock absorber can comprise one or more elastomeric protuberances that circumscribe an opening in the structural material. And, in some embodiments, the shock absorber can comprise an elastomeric material having a conical shape with a taper that distributes force upon impact to inhibit stress concentrations at the surface of the breakable container. In order to reduce the risk of breakage during application and removal of the casing, in some embodiments, the inner surface of the casing can have a coating that assists in the application and removal of the casing.

In some embodiments, the teachings are directed to a casing for a container. The casing comprises a structural material having an inner surface adapted to contact an outer surface of the container. The structural material functions as an outer protective layer for the container. In these embodiments, the casing further comprises a coating on the inner surface of the casing that functions to facilitate the application and removal of the casing from the container. In some embodiments, the container comprises, for example, a glass container, a drinking glass, or a glass baby bottle.

In some embodiments, the structural material comprises an elastomeric material, such as an elastomeric silicone material. In some embodiments, the structural material comprises a silicone rubber selected from the group consisting of ASTM D-2000 type FC, FE, and EG. In some embodiments, the coating can comprise a phthalate ester.

DETAILED DESCRIPTION OF THE INVENTION

As described above, the teachings provided herein are directed to an impact-resistant casing for breakable containers, and a system comprising the impact-resistant casing and a breakable container, such as a glass container. Very useful systems incorporating these components could include, of course, a glass baby bottle, a toddler sippy-cup, or an adult drinking glass, for example. These and other embodiments will be apparent to one of skill upon a review of the teachings provided herein.

Figure 1A:
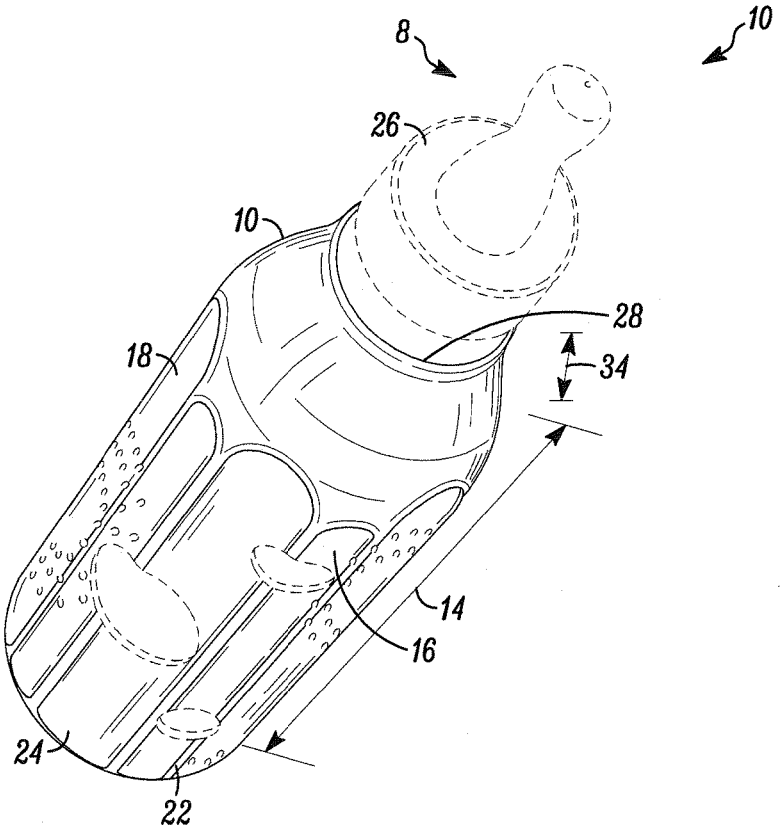
FIGS. 1A and 1B illustrate a state-of-the-art casing for a breakable container.
Figure 1B:
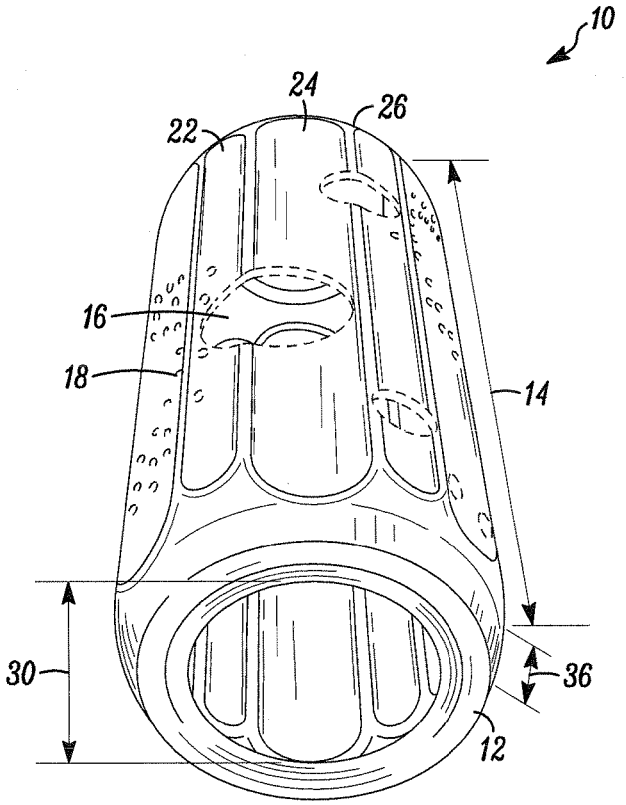

The impact-resistant casings taught herein offer a vast improvement over the current, state-of-the-art casings, as can be seen in the Examples included herein. FIGS. 1A and 1B illustrate a current, state-of-the-art casing. These casings are taught in U.S. Provisional Application No. 61/157,543, filed Mar. 4, 2009, which is hereby incorporated by reference in its entirety. FIG. 1A shows a casing 10 disposed on a glass baby bottle 8. The casing 10 includes a bottom portion 12 and a cylindrical side portion 14 that defines a plurality of viewing ports 16 that allow visualization of the contents of the container. The viewing ports 16 are vertically spaced about the side portion 14 of the casing. Also, grips 18 are disposed on the side portion of the bottle, providing an improved grip to help protect the glass baby bottle from breakage due to inadvertent dropping of the bottle.

In some embodiments, the grips 18 of the casing 10 are configured as raised dots arranged in circular patterns. The grips 18 may vary in number and may be arranged in an array of shapes and sizes. For example, the grips can be formed by recesses, or ridges, channels, or other variations of thickness of the casing to provide increased grip for the user. The grips 18 that are shown have a rounded shape but, it should be appreciated that, they may also come in a variety of other shapes, such as square, triangular, or rectangular, for example.

The side portion 14 of the casing 10 further includes planar sections 22, 24 of alternating or, potentially, variable sizes. In FIG. 1, the planar sides alternate from between planar section 22 and planar section 24. The planar sides can conform to a prescribed size of a baby bottle and help keep the casing snugly fit. In FIG. 1, for example, the planar section 22 can have a width of about 18 mm while planar section 24 may have a width of about 11 mm, for example. One of skill will appreciate that these dimensions will vary according to size of bottle, manufacturer, etc. One of skill will also appreciate that, as used herein, the term "about" refers to a variation that one of skill would understand as still providing an operable variation with respect to a particular use. For example, in some embodiments, a variation of 1 mm to 3 mm may not provide a substantial variation, but a variation of 5 mm may provide a clearly substantial variation, such that the product arguably becomes inoperable for its designated use. Likewise, the term "substantial" would be understood by one of skill throughout this specification to refer to a change that provides a marked variation, a variation that provides notable differences. With respect to the discussion of the planar sides, for example, these alternating planar sides may also have various lengths and widths according to the size of the baby bottle and the size of the casing. It should be appreciated that, in some embodiments, the planar sides can be excluded, and bottles of other styles can be employed. In fact, one of skill will appreciate that these principles of conformity of the casing and style of the container can apply to any breakable container protected by the products taught herein.

The casing 10 further includes a top section 26 that defines an opening to allow the casing to slide over the bottles. The top section 26 can taper inwardly from the cylindrical side portion 14 to the opening 28 to better secure the casing 10 around the bottle. The bottom portion 12 defines a bottom opening 30. In some embodiments, for example, the top opening 28 can have a diameter of about 38 mm while the bottom opening 32 has a diameter of about 30 mm, for example. The useful diameter of each opening can vary tremendously, of course, as would be well-appreciated by one of skill in the art of containers.

The casing 10 can have a thickness at the bottom end of about 2 mm and a thickness at the top end of about 1 mm, for example. The thickness of the casing may either consist of a consistent thickness or range from a thicker end to a thinner end. At each end of the casing, there can be a curved section 34 and 36, which allows the casing to snugly fit around the bottle and provide additional protection around the bottle. As such, one of skill will appreciate that the casing may be adapted to fit a wide range of bottle sizes, while maintaining its basic structure and quality.

Figure 2A:
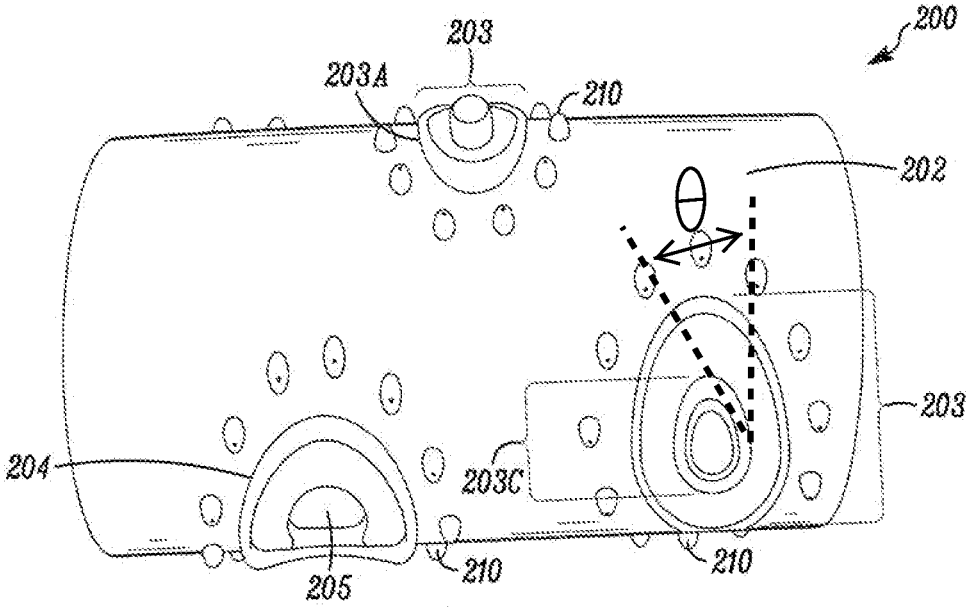
FIGS. 2A and 2B illustrate an impact-resistant casing, according to some embodiments.
Figure 2B:
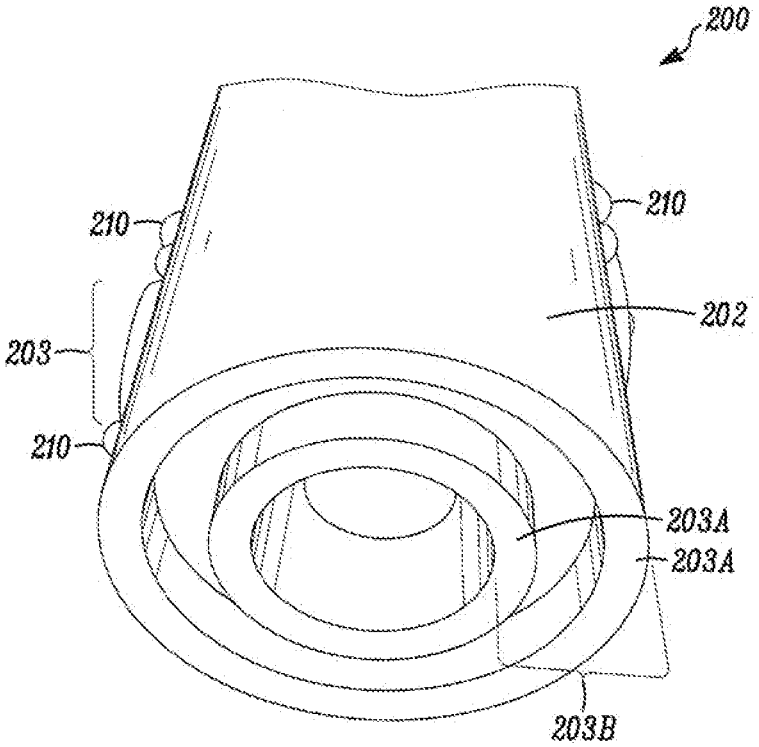

FIGS. 2A and 2B illustrate an impact-resistant casing, according to some embodiments. In some embodiments, such as shown in these FIGs, the teachings are directed to an impact-resistant casing for a breakable container. The casing 200 comprises a structural material 202 having a tubular shape with an inner surface adapted to contact an outer surface of a breakable container. The structural material 202 functions as an outer protective layer for the breakable container. In these embodiments, the casing further comprises a shock absorber 203 that functions to absorb an impact received by the breakable container and resist breakage of the breakable container upon receiving the impact. In some embodiments, the breakable container comprises, for example, a glass container, a drinking glass, or a glass baby bottle. The casing 200 can also have openings 205 to enable viewing of the contents and raised grips 210 to assist the user in gripping the casing.

One of skill will appreciate that the structural material can be any one or any combination of a variety of materials suitable for the applications taught herein. For example, in some embodiments, a suitable material may include an elastic material, a foamed or vulcanized rubber, neoprene, polyurethane, nylon, lycra, a non-toxic plastic, a silicone or silicone-containing material, or a combination thereof. In some embodiments, the structural material can include a polymerized siloxane, such as silicone, for example, a silicone produced by G.E. or Dow Chemicals. In some embodiments, the structural material comprises up to 35%, up to 40%, up to 50%, up to 55%, up to 60%, up to 65%, up to 70%, up to 80%, up to 85%, up to 90%, up to 95%, up to 98%, up to 99%, up to 99.9%, and up to 100% silicone. As such, the structural material can be formed into a sheet and compression or liquid injection molded into a desired form. One of skill will appreciate that the casing can be formed into any desired shape using manufacturing processes currently available in the art.

In some embodiments, the structural material 202 comprises an elastomeric material, such as an elastomeric silicone material. In some embodiments, the structural material comprises a silicone rubber selected from the group consisting of ASTM D-2000 type FC, FE, and EG.

One of skill will appreciate, however, that a variety of elastomeric materials may be suitable for an application of the teachings provided herein. Examples of elastomeric materials include, but are not limited to, a nitrile material, such as acrylonitrile-butadiene rubber; a hydrogenated nitrile material, such as hydrogenated acrylonitrile-butadiene rubber; an ethylene propylene material, such as ethylene propylene diene rubber; a fluorocarbon material, such as fluorocarbon rubber; a chloroprene material, such as chloroprene rubber; a silicone material, such as silicone rubber; a fluorosilicone material, such as fluorosilicone rubber; a polyacrylate material, such as polyacrylate rubber; an ethylene acrylic material, such as ethylene acrylic rubber; a styrene-butadiene material, such as styrene-butadiene rubber; a polyurethane material, such as polyester urethane or polyether urethane; or natural rubber. The choice of elastomeric material will depend on a variety of factors including, but not limited to, economy of the material, FDA approval for use with food or drink, compression set resistance, rebound or resilience, tear strength, heat aging resistance, ozone resistance, resistance to oil and grease, fuel resistance, water swell resistance, gas impermeability, abrasion resistance, and temperature resistance.

The thickness of the structural material can be any thickness found to be useful to one of skill for a particular application. In some embodiments, the thickness of the structural material can range from about 0.01 inches to about 0.05 inches, from about 0.03 inches to about 0.08 inches, from about 0.05 inches to about 0.10 inches, from about 0.075 inches to about 0.15 inches, from about 0.10 inches to about 0.25 inches, from about 0.15 inches to about 0.35 inches, from about 0.20 inches to about 0.50 inches, or any range therein. In some embodiments, the thickness of the structural material can range from about 0.25 inches to about 1.0 inches, from about 0.25 inches to about 0.75 inches, about 0.65 inches, or any range therein. In some embodiments, the structural material can range from about 2 mil to about 50 mil, from about 5 mil to about 25 mil, from about 5 mil to about 15 mil, from about 6 mil to about 12 mil, about 12 mil, or any range therein. As can be appreciated by one of skill, the 3-dimensional characteristics of any given casing will be determined by the container.

In some embodiments, the shock absorber 203 comprises an elastomeric material, such as an elastomeric silicone material. In some embodiments, the shock absorber 203 comprises a silicone rubber selected from the group consisting of ASTM D-2000 type FC, FE, and EG.

In some embodiments, the structural material 202 and the shock absorber 203 comprise a silicone rubber independently selected from the group consisting of ASTM D-2000 type FC, FE, EG, and a combination thereof.

In some embodiments, the shock absorber 203 comprises an elastomeric protuberance that extends outward from the surface of the structural material. The shock absorber can function to substantially reduce the frequency of breakage due to a force applied to the container at the site of the shock absorber when compared to the frequency of breakage due to the force applied to the container through a second casing, such as a current, state-of-the-art casing, consisting of the same or similar structural material and not having a shock absorber at the site of the applied force.

In some embodiments, the shock absorber 203 comprises an elastomeric material having the shape of a ring 203A. And, in some embodiments, the shock absorber comprises concentric rings 203B of an elastomeric material. The shock absorber 203 can comprise an elastomeric material having a conical shape 203C with a taper, θ (see also 303C in FIG. 3B), that distributes force upon impact to inhibit stress concentrations at the surface of the breakable container. In some embodiments, the conical shape 203C can have the apex removed and the body of the cone remaining hollow or concave (as shown), to create another ring-shaped protuberance and assist in the distribution of stresses upon impact through both the ring-shape and the taper, θ. The taper, θ, can, in some embodiments, have an angle (from an axis that is normal to the surface of the container) that varies from about 15° to about 85°, from about 25° to about 75°, from about 35° to about 60°, about 45°, or any range therein. In some embodiments, the shock absorber can comprise one or more elastomeric protuberances 204 that circumscribe an opening 205 in the structural material 202. The conical shape can be a right cone or oblique cone, for example, and it can be a circular cone or non-circular cone. Non-circular cones can include, for example, square cones, triangular cones, trapezoidal cones, and the like.

The shock absorber 203 can be placed at any conceivable location around the breakable container to reduce the frequency of breakage upon an impact. In some embodiments, the container has a base and a side, and the shock absorber 203, 203A, 203B is positioned at the base of the container. And, in some embodiments, the shock absorber 203, 203A, 203C, 204 is positioned at the side of the container.

One of skill will appreciate that the shock absorber can take a variety of shapes and sizes, as long as the shock absorber effectively reduces the stress applied to the breakable container upon impact. The shock absorber size will depend on the type of container and the placement of the shock absorber in relation to the container and its end use. One of skill will appreciate that the shapes and sizes can be almost endless. In some embodiments, the shock absorber comprises a ring with a diameter, a width and a height.

In some embodiments, the diameter of the shock absorber can range, for example, from about 0.25 inches to about 5.0 inches, from about 0.5 inches to about 3.5 inches, from about 0.5 inches to about 2.5 inches, from about 0.5 inches to about 1.5 inches, from about 0.5 inches to about 1.0 inches, about 0.75 inches, from about 1.25 inches to about 2.5 inches, about 2.25 inches, or any range therein. In some embodiments, the width of the shock absorber can range from about 0.01 inches to about 1.0 inches, from about 0.10 inches to about 0.5 inches, from about 0.125 inches to about 0.25 inches, or any range therein. In some embodiments, the height of the shock absorber can range from about 0.25 inches to about 2.5 inches, from about 0.35 inches to about 2.25 inches, from about 0.25 inches to about 2.0 inches, from about 0.25 inches to about 1.5 inches, from about 0.25 inches to about 1.0 inches, from about 0.25 inches to about 0.75 inches, from about 0.25 inches to about 0.50 inches, or any range therein.

In some embodiments, the shock absorber comprises a ring having a height of about 0.50 inches, a width of about 0.125 inches, and a diameter of about 2.25 inches. In some embodiments, the shock absorber comprises a ring having a height of about 0.50 inches, a width of about 0.125 inches, and a diameter of about 1.375 inches.

In some embodiments, the shock absorber comprises a conical shape having the apex removed and a concave center at its top portion, such that the cross section of the top of the conical shock absorber comprises a ring shape. In these embodiments, the shock absorber can have a height of about 0.25 inches, a width of about 0.1875 inches, and a diameter of about 0.75 inches. In these embodiments, the shock absorber can also have a height of about 0.25 inches, a width of about 0.1875 inches, and a diameter of about 0.625 inches. And, in these embodiments, the shock absorber can have a height of about 0.25 inches, a width of about 0.125 inches, and a diameter of about 0.50 inches.

In some embodiments, the shock absorber comprises a ring shape that encircles open holes in the structural material, such as viewing ports. In these embodiments, the ring can have a height of about 0.125 inches, a width of about 0.125 inches, and a diameter of about 1.625 inches. In these embodiments, the ring can also have a height of about 0.125 inches, a width of about 0.125 inches, and a diameter of about 1.25 inches. And, in these embodiments, the ring can also have a height of about 0.125 inches, a width of about 0.125 inches, and a diameter of about 1.0 inches.

The casing can have any number of shock absorbers, rings, or a combination thereof. In some embodiments, the casing has 3 rings, 4 rings, 5 rings, 6 rings, 7 rings, 8 rings, 9 rings, or 10 rings, on the side of the container. In these embodiments, 3 or more rings can include a shock absorber, such as a conical shock absorber, positioned concentric within the ring.

Grips can be added to reduce the risk of dropping a container. In some embodiments, the shock absorbers can be surround by grips ranging from about 0.10 inches to about 0.20 inches in all dimensions, from about 0.125 inches to about 0.175 inches in all dimensions, about 0.125 inches in all dimensions, or any range therein. In some embodiments, there are from about 5 to about 25 grips surrounding a ring. In some embodiments, there are 5, 6, 7, 8, 9, 10, 11, 12, 13, 14, 15, 16, 17, 18, 19, or 20 grips surround any given ring. And, in some embodiments, there can be various sizes of rings and various numbers of grips surrounding the rings. The grips can be placed at any position on the outer surface of the casing.

One of skill will appreciate that, depending on the size of the casing and type of container, there can be any number of viewing ports, or holes, in the structural material. In some embodiments, there can be from about 1 to about 50 viewing ports, or more, in the structural material. In some embodiments, there can be 2, 3, 4, or 5 holes in the casing that serve as viewing ports, for example. It should also be appreciated that the top of the casing should have an opening for receiving the container in some embodiments, and the bottom can also have an opening to assist the casing in conforming to a container. The openings have a separate utility of assisting the casing with conforming to a container. In some embodiments, the holes for viewing range from about 0.50 inches to about 0.75 inches in diameter. And, in some embodiments the viewing holes are always encircled by ring-shaped protuberances to provide protection from direct impact to the container inside the casing.

Figure 3A:
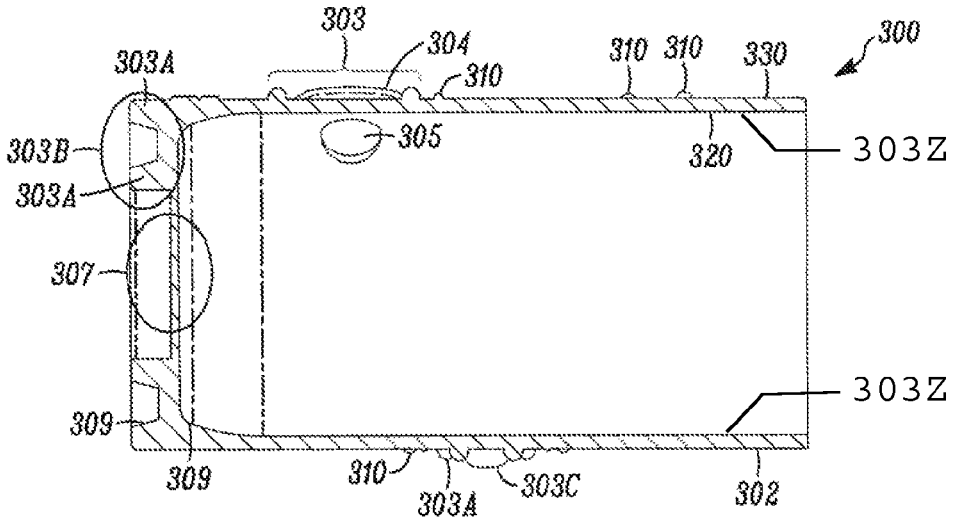
FIGS. 3A-3D illustrate features of an impact-resistant casing, according to some embodiments.
Figure 3B:
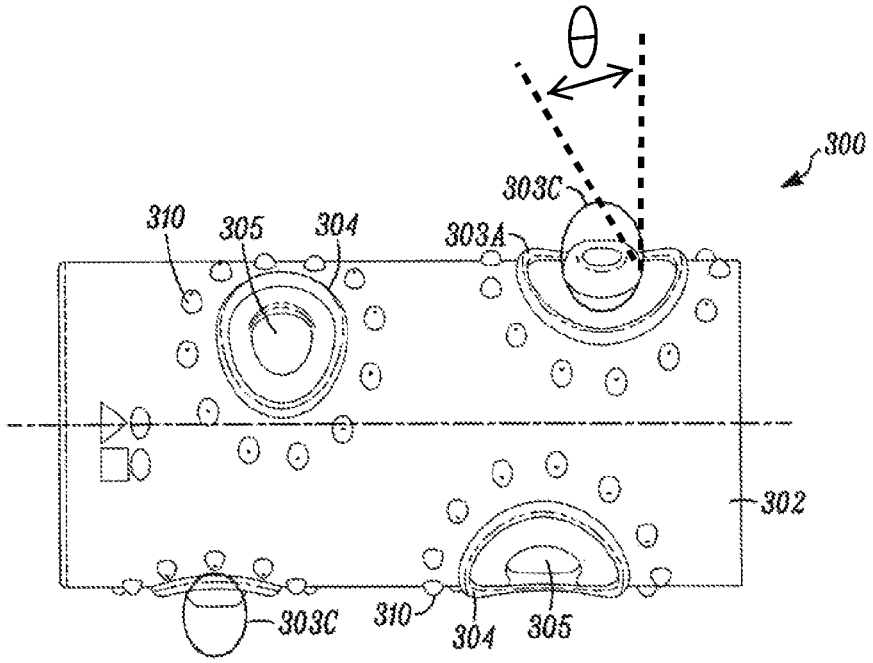
Figure 3C:
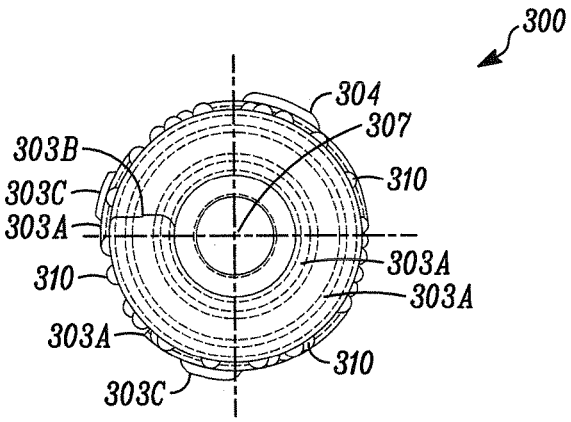
Figure 3D:
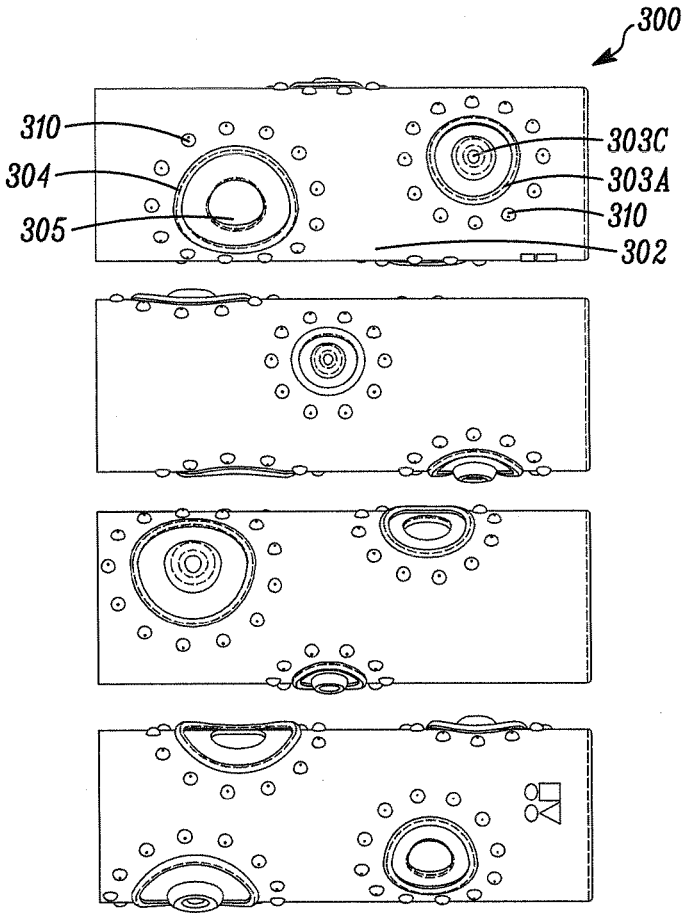

FIGS. 3A-3D illustrate features of an impact-resistant casing, according to some embodiments. FIGS. 3A and 3B illustrate the impact-resistant casing 300 from a vertical cross section and an outside view. Structural material 302 has an outer surface 330 and an inner surface 320 that contacts a container. Shock absorber 303 comprises a ring 304 that encircles a hole 305. The casing 300 also comprises a hole 307 at the base of the casing structure. At the base of the casing 300, there are concentric rings 303A,303A that form a concentric-ring shock absorber 303B. The rings have tapers 309 that function to distribute stress, and inner surface 320 also has a taper 309 for stress distribution across the bottom of a container upon impact. The tapers 309 can inhibit the creation of stress risers on the container that can increase point force and facilitate breakage. Conical shock absorber 303C is encircled by ring 303A on the side 330 of the structural material, and grips 310 encircle rings around the outer surface 330 of the structural material to reduce the risk of dropping the system and breaking the container. Many of these features can also be seen in FIG. 3C, which illustrates the base of the casing. FIG. 3D illustrates many of these features from an outside view of a rotating casing.

One of skill will also appreciate that a variety of hardness properties can be used for the shock absorber to provide a useful elastomeric distribution of stresses from an impact. The range of desired hardness can be selected knowing factors that include the material used to construct the container, the weight of the container, and the size and shape of the shock absorber. In some embodiments, the hardness of the materials used for the structural material or the shock absorber can be independently selected, and each can range, for example, almost anywhere within the Shore A range. For example, in some embodiments, the hardness can range from about 18 Shore A degrees to about 80 Shore A degrees. In some embodiments, the hardness of can range from about 25 Shore A degrees to about 90 Shore A degrees, from about 35 Shore A degrees to about 65 Shore A degrees, from about 40 Shore A degrees to about 50 Shore A degrees, about 45 Shore A degrees, or any range therein.

In many embodiments, its desirable to have a casing that is resistant to heat, aging, physical stresses, or some combination of these factors. Its desirable that the casing materials resist heat, for example, which can arise during washing and drying of the casing, from contact with a hot container, or from exposure to some other common heat source, such as direct sunlight in a hot automobile. One of skill would appreciate that there are so many materials available to use in the production of the casing that the heat resistance of the casings taught herein can range across about any practical temperature that the casing would experience during its useful life. In some embodiments, the casing can withstand temperatures ranging from about −50° C. to about 230° C., from about −20° C. to about 200° C., from about −10° C. to about 175° C., from about −5° C. to about 150° C., or any range therein.

In some embodiments, the casing material is selected to withstand radiation, such as microwave, ultraviolet, and infrared radiation. In some embodiments, the casing material is not naturally resistant to radiation, but an additive can be added to provide such resistance. Likewise, in some embodiments, the casing material can be selected to withstand ozone exposure, acids, bases. Moreover, the casing material can be selected to serve as an insulator, and the degree of insulation provided can be predetermined according to the selection of the casing material.

Its also desirable that the casing materials resist physical stresses, such as compression, tensile, tearing, and the like. Accordingly, in some embodiments, the casing materials are selected to have a desired set of physical characteristics to best assist in the end-use of the container.

The casing materials can be a mix of components, such as in the case of some silicone elastomerics, for example. A well-mixed silicone rubber material with the proper components can be a food grade material, unless the percentage of the components is outside of a desired range, or the manufacturer of the material is not using the white-carbon black in the proper way. Or, in some cases, the mixing material is a cheaper brand with unpredictable and variable component concentrations, for example. A mixture of raw silicone, silicone gel, and white-carbon black powder can include a color paste and be vulcanized under high heat. If the percentage of white-carbon black, for example, is too high or the quality of the components is not standard, the product could fail FDA testing for "food quality" grade. As such, the casings taught herein can be formed of a food-grade silicone material. Such materials may be durable and flexible to enable a repeated removal of the casing from a container, cleaning, and reuse. In some embodiments, the elasticity of the casing allows it to be stretched and pulled and still fit snugly around a container. The silicon material also allows for the casing to have a resilient quality to it, which enables it to spring back to its original shape, even if it becomes warped over time and use.

Its contemplated that a layered casing may be desirable, wherein the layers can be the same or different to provide a combination of characteristics that may be desirable in the casing, such as grip on the container, resistance to physical stresses, and insulation properties. In some embodiments, the layers are made from the same casing material, different casing materials, include an air space, or a combination thereof.

The casing not only reduces the frequency of breakage, but it also reduces the risk of breakage. In some embodiments, the structural material retains fractured material following a breakage of the breakable container. In some embodiments, the breakable container may be expected to fracture into small pieces if broken, such that any openings may be eliminated or minimized in size to help contain the small pieces. In some embodiments, the breakable container may be expected to fracture into larger pieces if broken, or perhaps not fracture into pieces at all, or to any appreciable extent, such that any openings may be enlarged, increased in number, or maximized in size. In such embodiments, one of skill can size the holes to virtually any dimension for a given end-use.

The casings can be formed using any method known to one of skill. For example, in some embodiments, the casings can be formed through an injection molding process to produce one complete piece. In some embodiments, the casings can be created as a continuous, unitary structure. In some embodiments, the casing can be created as a multi-piece set which is placed around the outside of the bottle and closed together with an adhesive material, or the like. Alternatively, the casings have a wrap-around feature configured to enable wrapping the casing around the bottle and fastening the casing mechanically using an attachment mechanism, such as hook- and loop material, snaps, buttons, or any other suitable mechanism known to one of skill.

The casing can also be modified for easier application to, and removal from, the breakable container. In some embodiments, the inner surface of the casing has a coating, 303Z in FIG. 3, that assists in the application and removal of the casing. Any suitable coating material can be used to facilitate the application and removal of the silicone from the container, and since different types of containers have different surface chemistries, different coatings may be preferable for different containers. In some embodiments, the coating can comprise a phthalate ester. Examples of phthalate esters include, but are not limited to, di-2-ethyl hexyl phthalate (DEHP), the diisodecyl phthalate (DIDP), the diisononyl phthalate (DINP), and benzylbutylphthalate (BBP). In some embodiments, the casing can be coated with a composition comprising a citrate-based plasticizer, such as esters of acetyl citrate. In some embodiments, the coating can comprise acetyl tributyl citrate (ATBC). And, in some embodiments, the casing can be coated with a composition comprising di(isononyl)cyclohexane-1, 2-dicarboxylate (DINCH).

Such a coating can be disposed on an outer and inner surface of the molded body to facilitate ease of application and removal of the casing. In some embodiments, a GE Toshiba spraying material and formula is used, and such a formulation can include a mixture of HS-4 as a base ingredient, XC-9603 as an adhesive assistant, YC-6831 as a catalyst. These mixtures can be obtained as pre-mixed formulations from GE Toshiba. A small amount of toluene is included in the formulation for spraying, and the toluene is removed by evaporation during the heating and curing process.

In some embodiments, the teachings are directed to an impact-resistant storage container system comprising a breakable container and any of the casings described above. In some embodiments, the teachings are directed to a drinking system. The drinking system can comprise a drinking glass having a base, a side, and an inner volume for containing a fluid; and, an impact-resistant casing comprising a structural material having an inner surface adapted to contact an outer surface of the drinking glass. In these embodiments, the structural material functions as an outer protective layer for the drinking glass. In these embodiments, the system also includes a shock absorber that functions to absorb an impact received by the drinking glass and resist breakage of the drinking glass upon receiving the impact. The structural material and the shock absorber comprise a silicone rubber independently selected from the group consisting of ASTM D-2000 type FC, FE, EG, and a combination thereof. In some embodiments, the drinking glass is a baby bottle.

The drinking system can include a shock absorber positioned at the base of the drinking glass and/or the side of the drinking glass. In some embodiments, the shock absorber comprises an elastomeric material having the shape of a ring. And, in some embodiments, the shock absorber comprises concentric rings of an elastomeric material. The shock absorber can comprise one or more elastomeric protuberances that circumscribe an opening in the structural material. And, in some embodiments, the shock absorber can comprise an elastomeric material having a conical shape with a taper that distributes force upon impact to inhibit stress concentrations at the surface of the breakable container. In order to reduce the risk of breakage during application and removal of the casing, in some embodiments, the inner surface of the casing can have a coating that assists in the application and removal of the casing.

One of skill will appreciate that nearly any portable container that may be subject to an impact that results in breakage of the container could benefit from the impact-resistant casings taught herein. Such containers can be made from any material that can be broken or crushed, whether cracked on comminuted into several pieces, such that the structure of the container fails under impact. Such containers can include glass containers, ceramic containers, plastic containers, composite material containers that include a combination of materials, woven or non-woven fiber containers, paper and cardboard containers, and the like. The containers can hold a solid, liquid, or gas, or the containers can be empty. The containers can have a removable lid, such as a screwtop; a TUPPERWARE or RUBBERMAID friction, clip, or buckle sealed top; or it can have a non-removable lid. The container can have a cork, or be designed to be sealed for opening later by invasive and mechanical means that are preselected to be reversible, such as by reapplying nails, staples or screws, for example, or they can be non-reversible such as by breaking sealed plastic or glass. The containers can be designed for food or drink, whether hot or cold, such as a thermos comprising a metal outer layer, and a vacuum-sealed ceramic or glass inner shell, such that breakage of the insulation could occur upon impact. And, as described above, the container can be a drinking glass, a baby bottle, or any other glass container, such as a jar, or the like.

Figure 4A:
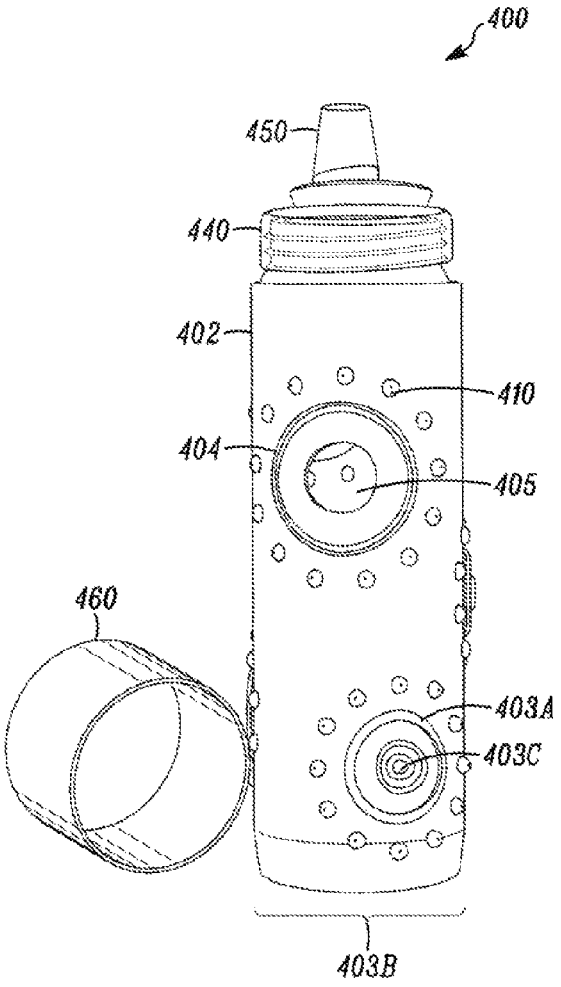
FIGS. 4A and 4B illustrate a sippy-cup drinking system having an impact-resistant casing, a glass container, a sippy attachment, and a lid, according to some embodiments.
Figure 4B:
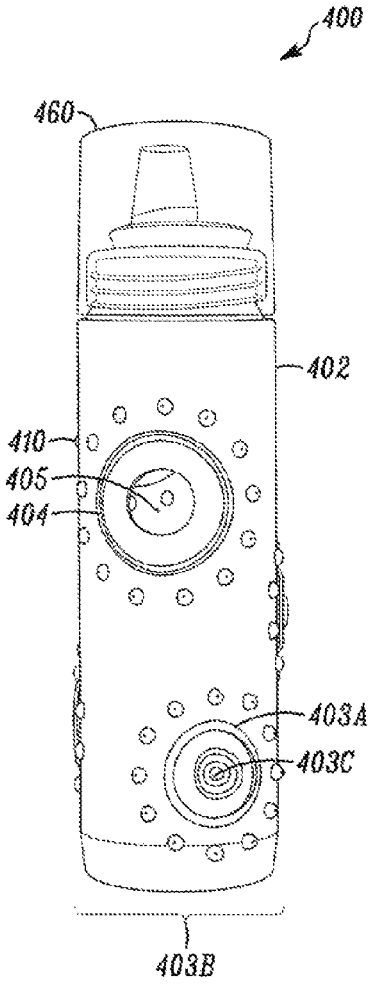
Figure 5:
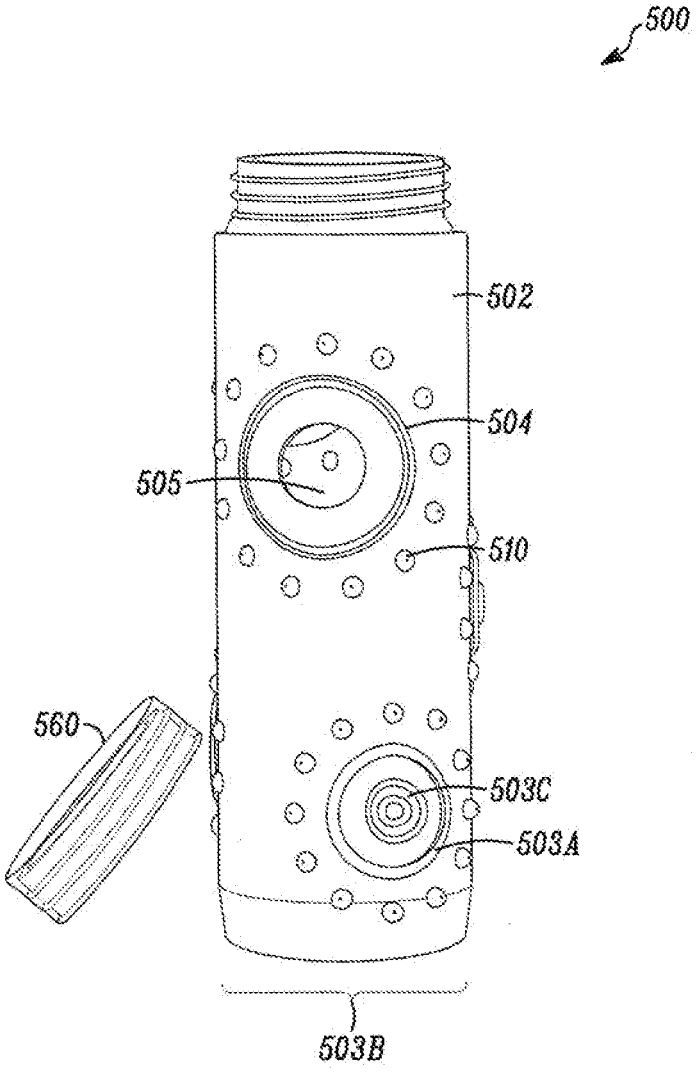
FIG. 5 illustrates a drinking system having an impact-resistant casing, a glass container, and a lid, according to some embodiments.
Figure 6:
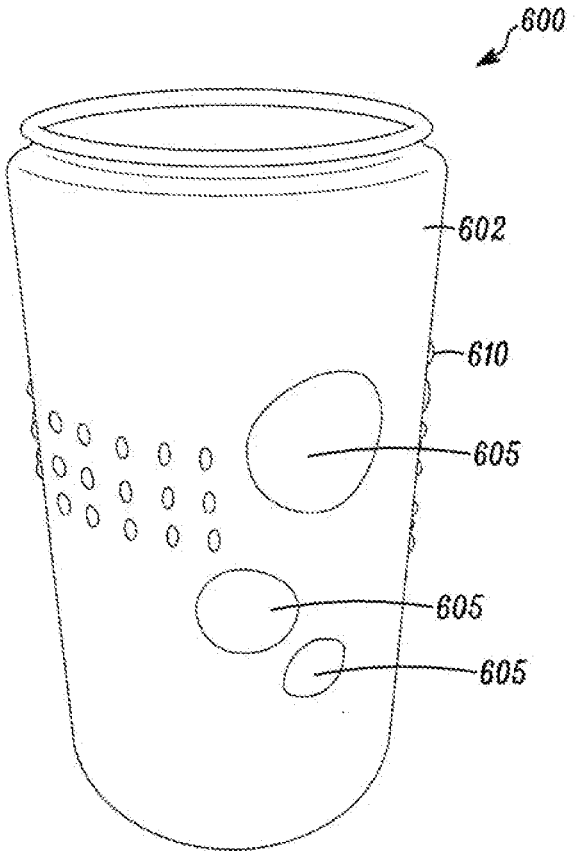
FIG. 6 illustrates a standard drinking system having a casing and a standard drinking glass, according to some embodiments.

FIGS. 4-6 show a variety of systems containing a variety of containers with casings taught herein. FIGS. 4A and 4B illustrate a sippy-cup drinking system having an impact-resistant casing, a glass container, a sippy attachment, and a lid, according to some embodiments. The casing in system 400 comprises a structural material 402 having a tubular shape with an inner surface adapted to contact an outer surface of a breakable container. The structural material 402 functions as an outer protective layer for the breakable container. In these embodiments, the casing further comprises a shock absorbers 403A, 403B, 403C that function to absorb an impact received by the breakable container and resist breakage of the breakable container upon receiving the impact. The casing in system 400 can also have openings 405 to enable viewing of the contents and raised grips 410 to assist the user in gripping the casing. Shock absorbers can comprise a ring 404 that encircles a hole 405. The casing in system 400 also comprises a hole (not shown) at the base of the casing structure. At the base of the casing in system 400, there are concentric rings (not shown) form a concentric-ring shock absorber 303B. Conical shock absorbers 403C are encircled by rings 403A on the side of the structural material, and grips 410 encircle rings around the outer surface of the structural material to reduce the risk of dropping the system and breaking the container. System 400 also includes retainer ring 440 to fasten sippy attachment 450 onto the container. Cap 460 can be included in the system to cover the sippy attachment 450.

FIG. 5 illustrates a drinking system having an impact-resistant casing, a glass container, and a lid, according to some embodiments. The casing in system 500 comprises a structural material 502 having a tubular shape with an inner surface adapted to contact an outer surface of a breakable container. The structural material 502 functions as an outer protective layer for the breakable container. In these embodiments, the casing further comprises a shock absorbers 503A, 503B, 503C that function to absorb an impact received by the breakable container and resist breakage of the breakable container upon receiving the impact. The casing in system 500 can also have openings 505 to enable viewing of the contents and raised grips 510 to assist the user in gripping the casing. Shock absorbers can comprise a ring 504 that encircles a hole 505. The casing in system 500 also comprises a hole (not shown) at the base of the casing structure. At the base of the casing in system 500, there are concentric rings (not shown) form a concentric-ring shock absorber 503B. Conical shock absorbers 503C are encircled by rings 503A on the side of the structural material, and grips 510 encircle rings around the outer surface of the structural material to reduce the risk of dropping the system and breaking the container. System 500 also includes cap 560 to cover the mouth of the container.

FIG. 6 illustrates a standard drinking system having a casing and a standard drinking glass, according to some embodiments. This casing in system 600 is a current, state-of-the-art casing as taught in the U.S. Provisional Application No. 61/157,543, filed Mar. 4, 2009, which is hereby incorporated by reference in its entirety. The casing in system 600 has structural material 602 having openings 605 and grips 610. In addition, the casing in system 600 comprises a coating on the inner surface of the casing to facilitate ease of application and removal of the casing from the drinking glass.

Without intending to be limited to any theory or mechanism of action, the following examples are provided to further illustrate the teachings presented herein. It should be appreciated that there are several variations and equivalents contemplated within the skill in the art, and that the examples are not intended to be construed as providing limitations to the claims.

Example 1

Production of a Silicone Structural Material

A silicone material can be preselected and purchased from any of a variety of manufacturers known to one of skill. The manufacturing method selected, however, affects the physical and chemical properties displayed by the silicone product. Its important to note that not all silicone rubbers are the same, and different grades can be selected for different applications of the teachings herein.

A typical silicone compound, for example, may have 5 to 12 ingredients in its formulation. Literally, you can add anything to silicone imaginable to achieve various results. The polymer itself can vary with regard to vinyl, methyl and phenyl percentages, plasticity or molecular weight, volatile content, and polymerization. In parts per hundred rubber (phr), a typical formulation may include a silicone base (100), fumed or precipitated silica (2-5), ground quartz or $CaCO_3$ (25-100), pigment (0.5-2.0), heat stabilizers (0.8-2.0), peroxides (0.8-1.4), acid acceptors or oil resistance additives (2.0-6.0), process aids for shelf life and green strength (0.3-2.0).

The material is usually easy to handle due to its low viscosity nature and very versatile with regard to compounding and fabrication. The various means of fabrication are continuous extrusion in a Ballotine, hot air vulcanization, liquid cure media, and infrared; molding with injection, transfer, and compression methods; wasteless/flashless transfer molding; and calendering. The most inexpensive method is through extrusion and splicing, whereas molding can be expensive due to the cost and maintenance of the molds. That said, wasteless/flashless molds can be cost effective due to less waste and accelerated cure times. The choice between extrusion and molding can also hinge upon the tolerances needed, since molding can produce closer tolerances than extrusion.

The silicone rubbers can also be produced to have expanded sponge profiles to reduce the cost of the product produced. ASTM D 1056 classifies sponge rubbers as Type 1 (open cell) or Type 2 (closed cell). The firmness, or compression-deflection capability of each type is classed from "Grade 0 (0.5 to 2 psi) to Grade 5 (17-25 psi)", where the psi is the pounds per square inch required to compress the sponge rubber by 25%.

The silicone rubbers typically have 10-90 Durometer, up to 1400 psi tensile strength, 100-1200% elongation, 275 ppi max tear resistance (Die B), temperature resistance from −100° C. to 316° C., and a compression set that is unequaled by other elastomers. Such rubbers will typically serve well for most applications of the casings: 40 years at 90° C., 10-20 years at 121° C., 5-10 years at 150° C., 2-5 years at 200° C., 3 months at 250° C., and 2 weeks at 315° C.

Example 2

Break-Point of Systems with Empty Glass Bottles

A state-of-the-art casing, as shown in FIGS. 1A-1B, was applied to an 8 oz glass baby bottle to create a state-of-the-art system, and the break-point of the state-of-the-art system was determined. The state-of-the-art system was dropped on its base onto a concrete surface, and breakage occurred at a drop-height of 4 feet.

An impact-resistant casing taught herein, as shown in FIGS. 2A-2B, was applied to the same type of baby bottle to create an improved system, and the system was likewise dropped on its base onto the concrete surface with the following results shown in Table 1:

TABLE 1

| | RESULTS | |
|---|---|---|
| DROP HEIGHT (ft) | State-of-the-Art Casing of FIG. 1 | Impact-Resistant Casing of FIG. 2 |
| 4 | Bottles broke every time | No bottles broke after 20 drops |
| 10 | N/A | No bottles broke after 20 drops<br>Bottles began bouncing and spinning in air after impact at this height |
| 18 | N/A | No bottles broke after ?? drops |

As can be seen from the above data, the impact-resistant casing provides a vast improvement over the existing product. The degree of improvement was much greater than expected, as the shock absorbers provided a rather unexpected amount of, resistance to the breakage of the glass bottles.

Example 3

Break-Point of Systems with Glass Bottles Containing a Fluid

Empty bottles will not carry as much force upon impact as a bottle containing a fluid, and real-world use of a bottle will include dropping a bottle containing a fluid. This example compares the breakage obtained using the state-of-the-art casing of Example 2 and the breakage obtained using the impact-resistant casing of Example 2 when using bottles containing a fluid.

The state-of-the-art casing was applied to an 8 oz baby bottle containing 4 oz water to create a state-of-the-art system containing a fluid, and the system was dropped 6 times—each time the glass bottle broke when dropped on its based on the concrete surface. The impact-resistant casing was applied to the same type of baby bottle containing 4 oz water to create an improved system containing a fluid, and the system was dropped 30 times at increasing heights onto the concrete surface with the following results as shown in Table 2:

TABLE 2

| | RESULTS | |
|---|---|---|
| DROP HEIGHT (ft) | State-of-the-Art Casing of FIG. 1 | Impact-Resistant Casing of FIG. 2 |
| 3-4 | Used 6 bottles. Started with first two bottles at 4 feet, and they both broke; the remaining 4 bottles broke at 3 feet | N/A |
| 6 | N/A | Dropped 5 bottles, and no bottles broke |
| 7 | N/A | Dropped 5 bottles, and no bottles broke. |
| 8 | N/A | Dropped 10 bottles, and no bottles broke |
| 10 | N/A | Dropped 10 bottles, and no bottles broke |

As can be seen from the above data in both Example 2 and Example 3, the impact-resistant casing provides a vast improvement over the existing product. The degree of improvement was much greater than expected, and in fact was quite remarkable, even in the heavier and more forceful fluid containing systems. The shock absorbers were expected to show improvement, however, they provided a rather unexpected amount of resistance to the breakage of the glass bottles in every case. It was very surprising to see these systems withstand such a substantial force without breakage of glass, particularly in the case of the fluid-containing systems.

Example 4

Impact-Resistant Systems Dropped from an Extreme Height

In Examples 2 and 3 above, the break-point of the systems with the 8 oz glass bottles was surprisingly not yet discovered. In this example, the impact-resistant system was taken to a new extreme height of 40 feet and, again, dropped on concrete. Interestingly, the bottles still did not break when they landed on their base! However, the long drop gave 2 out of 6 bottles a chance to turn in the air and land on the topside of the system, where there is no shock absorber. This likely occurred because the extreme height test was performed without having a fluid in the bottle. Of course, bottles receiving such an enormous impact at a site not having a shock absorber did break.

Again, the impact-resistant container system showed highly unexpected and, in fact, surprisingly incredible results. One of skill would certainly not have been able to predict that glass bottles dropped 40 feet onto a concrete surface would not break due to the mere presence of the impact-resistant casings taught herein.

We claim:

1. A drinking system with shock absorbers having stress distribution tapers, the system comprising:

an impact resistant casing comprising an elastomeric structural material having an inner surface adapted to contact an outer surface of the drinking glass, wherein the structural material functions as an outer protective layer for the drinking glass, wherein the elastomeric structural material includes a base and a cylindrical side extending from the base;

and, one or more shock absorbers positioned on an outer surface of the cylindrical side of the elastomeric structural material, wherein each shock absorber includes at least one ring and a concentric conical shape that protrudes outward from a surface of the cylindrical side, wherein the ring encircles the conical shape, wherein a height of the conical shape is greater than a height of the ring, wherein the one or more shock absorbers function to absorb an impact received by the drinking glass and resist breakage of the drinking glass upon receiving the impact; each of the rings having a hardness ranging from about 18 Shore A degrees to about 80 Shore A degrees, wherein, the shock absorber is configured to substantially reduce the frequency of breakage due to a force applied to the drinking glass at the site of the shock absorber when compared to the frequency of breakage due to the force applied to the drinking glass through a second casing consisting of the same structural material and not having a shock absorber at the site of the applied force; and, the structural material and the shock absorber comprise a silicone rubber independently selected from the group consisting of ASTM D-2000 type FC, FE, EG, and a combination thereof.

2. An impact-resistant casing for a breakable container comprising:

an elastomeric structural material having an inner surface adapted to contact an outer surface of a breakable container, wherein the structural material functions as an outer protective layer for the breakable container, wherein the elastomeric structural material includes a base and a cylindrical side extending from the base;

and, a plurality of shock absorbers positioned on an outer surface of the cylindrical side of the elastomeric structural material, wherein each shock absorber includes at least two concentric rings, wherein the shock absorbers function to absorb an impact and resist breakage of the breakable container upon receiving the impact; each of the rings extending normal to the base and having a hardness ranging from about 18 Shore A degrees to about 80 Shore A degrees wherein at least one shock absorber includes a conical shape encircled by the at least two concentric rings, wherein the conical shape protrudes outward from a surface of the cylindrical side with a taper, θ, of about 15° to about 85° to further distribute stresses upon an impact, wherein the taper is measured from an axis that is normal to the side of the elastomeric structural material, wherein a height of the conical shape is greater than a height the at least two concentric rings;

wherein, the shock absorber is configured to substantially reduce the frequency of breakage due to a force applied to the container at the site of the shock absorber when compared to the frequency of breakage due to the force applied to the container through a second casing consisting of the same structural material and not having a shock absorber at the site of the applied force.

3. The casing of claim 2, wherein the breakable container comprises a glass container.

4. The casing of claim 2, wherein the breakable container is a drinking glass.

5. The casing of claim 2, wherein the breakable container is a glass baby bottle.

6. The casing of claim 2, wherein the structural material comprises an elastomeric material having a thickness ranging from about 2 mil to about 50 mil.

7. The casing of claim 2, wherein the structural material comprises an elastomeric silicone material.

8. The casing of claim 2, wherein the structural material comprises a silicone rubber selected from the group consisting of ASTM D-2000 type FC, FE, and EG.

9. The casing of claim 2, each of the concentric rings having (i) a height ranging from about 0.25 inches to about 0.75 inches, (ii) a width ranging from about 0.10 inches to about 0.50 inches; and (iii) a diameter ranging from about 1.25 inches to about 2.5 inches.

10. The casing of claim 9, wherein at least one shock absorber includes a conical shape encircled by the concentric ring, wherein the conical shape protrudes outward from a surface of the cylindrical side with a taper that distributes force upon impact to inhibit stress concentrations at the surface of the breakable container.

11. The casing of claim 2, wherein the shock absorber comprises a silicone rubber selected from the group consisting of ASTM D-2000 type FC, FE, and EG.

12. The casing of claim 2, wherein the structural material and the shock absorber comprise a silicone rubber independently selected from the group consisting of ASTM D-2000 type FC, FE, EG, and a combination thereof.

13. The casing of claim 2, wherein at least one concentric ring of the shock absorber circumscribes an opening in the structural material.

14. The casing of claim 2, wherein at least one concentric ring of the shock absorber is positioned around a viewing port at the cylindrical side of the container.

15. The casing of claim 2, wherein the structural material is configured to retain fractured material following a breakage of the breakable container.

16. The casing of claim 2, wherein the inner surface of the casing has a coating that assists in the application and removal of the casing.

17. An impact-resistant container system comprising a breakable container and the casing of claim 2.

* * * * *